US009580664B2

(12) United States Patent
Xu et al.

(10) Patent No.: US 9,580,664 B2
(45) **Date of Patent: *Feb. 28, 2017**

(54) CATALYTIC CONVERSION METHOD FOR IMPROVING PRODUCT DISTRIBUTION

(75) Inventors: Youhao Xu, Beijing (CN); Shouye Cui, Beijing (CN); Siwei Liu, Beijing (CN); Nan Jiang, Beijing (CN); Yinliang Liu, Beijing (CN)

(73) Assignees: CHINA PETROLEUM & CHEMICAL CORPORATION, Beijing (CN); RESEARCH INSTITUTE OF PETROLEUM PROCESSING, SINOPEC, Beijing (CN)

( * ) Notice: Subject to any disclaimer, the term of this patent is extended or adjusted under 35 U.S.C. 154(b) by 956 days.

This patent is subject to a terminal disclaimer.

(21) Appl. No.: 13/825,975

(22) PCT Filed: Sep. 23, 2011

(86) PCT No.: PCT/CN2011/001613

§ 371 (c)(1),
(2), (4) Date: Apr. 25, 2013

(87) PCT Pub. No.: WO2012/041007

PCT Pub. Date: Apr. 5, 2012

(65) Prior Publication Data

US 2013/0211167 A1 Aug. 15, 2013

(30) Foreign Application Priority Data

Sep. 27, 2010 (CN) ..... 2010 1 0292903
Sep. 27, 2010 (CN) ..... 2010 1 0292906

(51) Int. Cl.
*C10G 69/04* (2006.01)
*C10G 11/18* (2006.01)

(52) U.S. Cl.
CPC ..... *C10G 69/04* (2013.01); *C10G 11/18* (2013.01); *C10G 11/187* (2013.01)

(58) Field of Classification Search
CPC ..... C10G 69/04
(Continued)

(56) References Cited

U.S. PATENT DOCUMENTS 5,234,575 A * 8/1993 Haag ..... C10G 51/026 208/120.01
5,234,576 A * 8/1993 Haag ..... C10G 57/00 208/106

(Continued)

FOREIGN PATENT DOCUMENTS

CN 1310223 A 8/2001
CN 1076751 C 12/2001

(Continued)

OTHER PUBLICATIONS

Tan Junjie et al. "Laboratory Simulation of the FCC Commercial Equilibrium Catalyst," Petroleum Refinery Engineering, Nov. 2003, vol. 33, Issue 11, pp. 15-17.

*Primary Examiner* — Sharon Pregler
(74) *Attorney, Agent, or Firm* — Novick, Kim & Lee, PLLC; Allen Xue

(57) ABSTRACT

The present invention relates to a catalytic conversion process for improving the product distribution, characterized in that a feedstock oil of good quality is contacted with a hot regenerated catalyst having a lower activity in a reactor to carry out a cracking reaction, the reaction product is separated from the spent catalyst to be regenerated, then the reaction product is fed into a separation system, and the spent catalyst to be regenerated is stripped, regenerated and recycled in the process. The isobutene content in the liquefied petroleum gas (LPG) produced by the process is increased by a factor of more than 30%, and the olefin (Continued)

content in the gasoline composition may be increased to more than 30 wt. %. The product distribution is optimized, and the yields of dry gas and coke are decreased, so as to sufficiently utilize the petroleum resources.

20 Claims, 2 Drawing Sheets

(58) Field of Classification Search
USPC ..... 585/600 S
See application file for complete search history.

(56) References Cited

U.S. PATENT DOCUMENTS

| | | | | |
|---|---|---|---|---|
| 5,243,121 | A * | 9/1993 | Madon | B01J 29/084 208/120.01 |
| 2010/0326888 | A1* | 12/2010 | Xu | B01J 29/06 208/120.01 |

FOREIGN PATENT DOCUMENTS

| | | | |
|---|---|---|---|
| CN | 1076752 | C | 12/2001 |
| CN | 1078094 | C | 1/2002 |
| CN | 1388217 | A | 1/2003 |
| CN | 1566267 | A | 1/2005 |
| CN | 1611574 | A | 5/2005 |
| CN | 1978596 | A | 6/2007 |
| CN | 101205475 | A | 6/2008 |
| CN | 101205476 | A | 6/2008 |
| CN | 101210188 | A | 7/2008 |
| CN | 101724430 | A | 6/2010 |

* cited by examiner

CATALYTIC CONVERSION METHOD FOR IMPROVING PRODUCT DISTRIBUTION

TECHNICAL FIELD

The present invention relates to a catalytic conversion process for improving the product distribution, more specifically a catalytic conversion process for increasing the isobutene content in the liquefied petroleum gas and the olefin content in the gasoline.

BACKGROUND OF THE INVENTION

Since its birth in 1940s, catalytic cracking has been the main process for lightening heavy oils. One of the reasons is that the raw materials thereof come from a variety of sources, including gas oil, atmospheric residue, deasphalted oil of vacuum residue, or partially doped vacuum residue. Secondly, the production solutions are flexible and may be the fuel-type, or fuel-chemical engineering type, e.g. producing more gasoline, diesel oil, propylene and the like. Thirdly, the product properties can be correspondingly adjusted by modifying the catalyst formulation and changing the processing parameters, e.g. increasing the octane number of gasoline, reducing the olefin content in gasoline and the like.

The conventional catalytic cracking techniques are primarily used for producing gasoline, wherein the gasoline yield is as high as more than 50 wt. %. At the beginning of 1980s, unleaded gasoline drives the catalytic cracking techniques to the direction of producing gasoline with high octane number. Thus the technological conditions of catalytic cracking and catalyst type greatly change. In the technological aspect, there primarily include increasing the reaction temperature, reducing the reaction time, increasing the reaction severity level, inhibiting the hydrogen transfer and overcracking reactions and improving the efficiency of contacting the oil and gas at the bottom of the riser with the catalyst. In the catalyst aspect, the catalysts formed by combining USY-type zeolites with inert substrate or active substrate and compounded from different types of zeolites are developed.

The catalytic cracking techniques have achieved the developments above, satisfied the requirements on Pb-free gasoline and increase the octane number of gasoline. However, either the change of the technological conditions or use of novel zeolite catalyst to increase the octane number of gasoline increases the octane number of gasoline by increasing the olefin content in the gasoline components. The olefin content in the current gasoline components ranges from 35 to 65 wt. %, which is greatly different from the requirements on the olefin content in the new gasoline. The olefin content in the liquefied petroleum gas composition is higher and about 79 wt. %, wherein butene is in a content of several times of the content of isobutane and cannot be used as the alkylation raw materials.

ZL99105904.2 discloses a catalytic conversion method for preparing isobutane and isoalkane-enriched gasoline comprising feeding the preheated feedstock oil into a reactor having two reaction zones, contacting with a hot cracking catalyst, wherein the reaction in the first reaction zone is conducted at 530-620° C. for 0.5-2.0 s; the reaction in the second reaction zone at 460-530° C. for 2-30 seconds, separating the reaction product, stripping the spent catalyst to be regenerated, feeding the stripped catalyst into the regenerator, coking and recycling. The content of isobutane in liquefied petroleum gas produced according to the method in the invention is 20-40 wt. %; the content of isoalkane in the gasoline composition is 30-45 wt. %; and its olefin content is deceased to less than 30 wt. %; the RON ranges from 90 to 93; the MON ranges from 80 to 84.

ZL99105905.0 discloses a catalytic conversion process for producing propylene, isobutane and isoalkane-enriched gasoline, comprising feeding the preheated feedstock oil into a reactor having two reaction zones, contacting with a hot cracking catalyst, wherein the reaction in the first reaction zone is conducted at 550-650° C. for 0.5-2.5 s; the reaction in the second reaction zone at 480-550° C. for 2-30 seconds, separating the reaction product, stripping the spent catalyst to be regenerated, feeding the stripped catalyst into the regenerator, coking and recycling. The yield of the liquefied petroleum gas can reach 25-40 wt. %, in which the contents of propylene and isobutane are about 30 wt. % and 20-40 wt. % respectively. The yield of gasoline can reach 35-50 wt. %, in which the isoalkane is 30-45 wt. %

ZL99105903.4 discloses a riser reactor for fluidized catalytic conversion, being equipped with a pre-lifting section, a first reaction zone, a diameter-enlarged second reaction zone, and a diameter-reduced outlet zone which are coaxial with each other and arranged from the bottom up along the vertical direction in turn, wherein the a horizontal pipe is connected with the end of the outlet zone. Such reactor not only can control the technological conditions in the first and second reaction zones, but also can enable the feedstock oils having different properties to be stepwisely cracked so as to obtain the required products.

These patents construct the base patents of FCC Process for Maximizing Iso-Paraffins (MIP) and are widely applied. Currently they are applied in about 50 sets of FCC units, and achieve great economic and social benefits. Liquefied petroleum gas enriched in isobutane and gasoline enriched in iso-paraffins can be obtained according to the prior art. However, for the treatment of the feedstock oil of good quality for catalytic cracking, especially hydrogenated gas oil, the olefin content of the resultant gasoline and the isobutene content in the liquefied petroleum gas are lower, the product distribution is not adequately optimized, and the petroleum resources are not sufficiently utilized.

SUMMARY OF THE INVENTION

The object of the present invention is to provide a catalytic conversion process for improving the product distribution, in particular increasing the isobutene content in the liquefied petroleum gas, increasing the olefin content in the gasoline and decreasing the dry gas and coke yields.

In the first aspect, the present application provides a catalytic conversion process for improving the product distribution, wherein a feedstock oil of good quality is contacted with a hot regenerated catalyst having a lower activity (average activity) in a reactor to carry out a cracking reaction, the reaction product is separated from the spent catalyst to be regenerated, then the reaction product is fed into a separation system, and the spent catalyst to be regenerated is stripped, regenerated and recycled in the process.

In the second aspect, the present application provides a catalytic conversion process for improving the product distribution, wherein a feedstock oil of good quality is contacted with a hot regenerated catalyst having a lower activity (average activity) in the lower part of the reactor to carry out a cracking reaction, followed by a selective hydrogen transfer reaction and isomerization reaction during the upward movement of the cracking reaction product and coke-containing catalyst, the product of the selective hydrogen transfer reaction and isomerization reaction is separated from the spent catalyst to be regenerated, then the product of the selective hydrogen transfer reaction and isomerization reaction is fed into a separation system, and the spent catalyst to be regenerated is stripped, regenerated and recycled in the process.

The reactor used in the present catalytic conversion process involves a commercial (industrial) catalytic cracking unit, rather than a simulating unit in the laboratory. In other words, the hot regenerated catalyst having a lower activity (average activity) is fed or made up into the commercial catalytic cracking unit, for purpose of improving the product distribution, in particular the isobutene content in the liquefied petroleum gas and the olefin content in the gasoline.

In some embodiments in the first and second aspects, the reactor is one selected from an isodiametric riser, a riser with an equal linear velocity, a riser with variable diameters and a fluidized bed, or a complex reactor consisting of an isodiametric riser and a fluidized bed. Preferably, the riser with variable diameters comprises in turn a pre-lifting section, a first reaction zone, a second reaction zone having an enlarged diameter, and an outlet zone having a reduced diameter, which are coaxial with each other and arranged from the bottom up along a vertical direction, and a horizontal pipe is connected with the end of the outlet zone, wherein the ratio of the diameter of the second reaction zone to the diameter of the first reaction zone ranges from 1.5 to 5.0:1.

In some embodiments in the first and second aspects, the feedstock oil of good quality is one or more selected from atmospheric distillation tower overhead oil, gasoline, catalytic gasoline, diesel oil, vacuum gas oil (VGO) and hydrogenated vacuum gas oil.

In some embodiments in the first and second aspects, the hot regenerated catalyst has an activity (average activity) of from 35 to 55, preferably from 40 to 50.

In some embodiments in the first and second aspects, the hot regenerated catalyst having a lower activity has a relatively homogeneous activity distribution. In further embodiments, the hot regenerated catalyst having a relatively homogeneous activity distribution has an initial activity of not higher than 80, preferably not higher than 75, more preferably not higher than 70, a self balancing time of from 0.1 to 50 h, preferably from 0.2 to 30 h, more preferably from 0.5 to 10 h, and a equilibrium activity of from 35 to 60 preferably from 40 to 50, when fed into the catalytic cracking unit.

In some embodiments in the first aspect, the reaction is conducted under the conditions including a reaction temperature of from 450° C. to 620° C., preferably from 500° C. to 600° C., a reaction time of from 0.5 to 35.0 second, preferably from 2.5 to 15.0 s, and a catalyst/feedstock oil weight ratio of 3-15:1, preferably 3-12:1.

In some embodiments in the second aspect, the cracking reaction is conducted under the conditions including a reaction temperature of from 490° C. to 620° C., preferably from 500° C. to 600° C., a reaction time of from 0.5 to 2.0 second, preferably from 0.8 to 1.5 s, and a catalyst/feedstock oil weight ratio of 3-15:1, preferably 3-12:1.

In some embodiments in the second aspect, the hydrogen transfer reaction and isomerization reaction are conducted under the conditions including a reaction temperature of from 420° C. to 550° C., preferably from 460° C. to 500° C., and a reaction time of from 2 to 30 s, preferably from 3 to 15 s.

In the first and second aspects, each of the cracking reaction, hydrogen transfer reaction and isomerization reaction is conducted under the conditions including a pressure of from 130 to 450 kPa, and a vapor/feedstock oil weight ratio of 0.03 to 0.3:1.

In the first aspect, the process provided in the present invention is specifically conducted as follows:

(1) feeding the preheated feedstock oil of good quality into the reactor, contacting with a hot regenerated catalyst having an activity of from 35 to 55, preferably from 40 to 50 or a hot regenerated catalyst having an activity of from 35 to 55, preferably from 40 to 50 and a relatively homogeneous activity distribution, reacting under the conditions including a reaction temperature of from 490° C. to 620° C., preferably from 500° C. to 600° C., a reaction time of from 0.5 to 35.0 s, preferably from 2.5 to 15.0 s, and a catalyst/feedstock oil weight ratio (hereinafter referred to as the catalyst/oil ratio) of 3-15:1, preferably 3-12:1;

(2) separating the produced oil and gas from the spent catalyst to be regenerated; and (3) separating the oil and gas to obtain liquefied petroleum gas enriched in isobutene, gasoline having a moderate olefin content and other reaction products, stripping the spent catalyst to be regenerated, feeding the catalyst into the regenerator, coking and recycling.

The reaction in step (1) is conducted under the conditions including a pressure of from 130 to 450 kPa, and a steam/feedstock oil weight ratio (hereinafter referred to as the steam/oil ratio) of 0.03 to 0.3:1, preferably from 0.05 to 0.3:1.

In the second aspect, the process provided in the present invention is specifically conducted as follows:

(1) feeding the preheated feedstock oil of good quality into the reactor, contacting with a hot regenerated catalyst having an activity of from 35 to 55, preferably from 40 to 50 or a hot regenerated catalyst having an activity of from 35 to 55, preferably from 40 to 50 and a relatively homogeneous activity distribution, cracking under the conditions including a reaction temperature of from 490° C. to 620° C., preferably from 500° C. to 600° C., a reaction time of from 0.5 to 2.0 s, preferably from 0.8 to 1.5 s, and a catalyst/feedstock oil weight ratio (hereinafter referred to as the catalyst/oil ratio) of 3-15:1, preferably 3-12:1;

(2) moving the produced oil and gas and the used catalyst upward, conducting the selective hydrogen transfer reaction and isomerization reaction under the conditions including a reaction temperature of from 420° C. to 550° C., preferably from 460° C. to 500° C., a reaction time of from 2 to 30 s, preferably from 3 to 15 s; and (3) separating the reaction product of step (2) to obtain liquefied petroleum gas enriched in isobutene, gasoline having a moderate olefin content and other products, stripping the spent catalyst to be regenerated, feeding the catalyst into the regenerator, coking and recycling.

The cracking reaction in step (1), and the hydrogen transfer reaction and isomerization reaction in step (2) all are conducted under the conditions including a pressure of from 130 to 450 kPa, and a steam/feedstock oil weight ratio (hereinafter referred to as the steam/oil ratio) of 0.03 to 0.3:1, preferably from 0.05 to 0.3:1.

The process of the present invention is especially suitable for increasing the isobutene content in the liquefied petroleum gas and the olefin content in the gasoline. The process provided in the present invention can be conducted in the isodiametric riser, riser having an equal linear velocity or fluidized bed reactor, wherein the isodiametric riser is the same as the conventional catalytic cracking reactor in the refinery, and the flow rates of the fluids in the riser having an equal linear velocity are substantially the same. In the isodiametric riser and riser reactor having an equal linear velocity, there are a pre-lifting section, first reaction zone and second reaction zone from below in turn; in the fluidized bed reactor, there are the first and second reaction zones from below in turn, wherein the ratio of the height of the first reaction zone to the height of the second reaction zone 10-40:90-60. When the isodiametric riser, riser having an equal linear velocity or fluidized bed reactor is used, one or more quenching medium inlets are set up at the bottom of the second reaction zone, and/or a catalyst cooler is set up in the second reaction zone, wherein the height of the catalyst cooler ranges from 50 to 90% of the height of the second reaction zone; and the temperature and reaction time in each reaction zone are controlled respectively. The quenching medium is selected from the quenching agent, cooled regenerated catalyst and cooled semi-regenerated catalyst, or mixtures thereof in any ratio, wherein the quenching agent is selected from liquefied petroleum gas, crude gasoline, stabilized gasoline, diesel oil, heavy diesel oil and water, or mixtures thereof in any ratio. The cooled regenerated catalyst and cooled semi-regenerated catalyst are obtained from the spent catalyst to be regenerated by two-stage regeneration and one-stage regeneration respectively. The regenerated catalyst has a carbon content of lower than 0.1 wt. %, preferably lower than 0.05 wt. %; the semi-regenerated catalyst has a carbon content of from 0.1 to 0.9 wt. %, preferably from 0.15 to 0.7 wt. %.

In some solutions in the first and second aspect, the process provided in the present invention can also be conducted in the complex reactor consisting of an isodiametric riser and a fluidized bed, wherein the lower isodiametric riser is the first reaction zone; the upper fluidized bed is the second reaction zone; and the temperature and reaction time in each reaction zone are controlled respectively. One or more quenching medium inlets are set up at the bottom of the fluidized bed, and/or a catalyst cooler is set up in the second reaction zone, wherein the height of the catalyst cooler ranges from 50 to 90% of the height of the second reaction zone; and the temperature and reaction time in each reaction zone are controlled respectively. The quenching medium is selected from the quenching agent, cooled regenerated catalyst and cooled semi-regenerated catalyst, or mixtures thereof in any ratio, wherein the quenching agent is selected from liquefied petroleum gas, crude gasoline, stabilized gasoline, diesel oil, heavy diesel oil and water, or mixtures thereof in any ratio. The cooled regenerated catalyst and cooled semi-regenerated catalyst are obtained from the spent catalyst to be regenerated by two-stage regeneration and one-stage regeneration respectively. The regenerated catalyst has a carbon content of lower than 0.1 wt. %, preferably lower than 0.05 wt. %; the semi-regenerated catalyst has a carbon content of from 0.1 to 0.9 wt. %, preferably from 0.15 to 0.7 wt. %.

In some solutions in the first and second aspects, the process provided in the present invention can also be conducted in the riser reactor with varied diameters (see ZL99105903.4). The structural features of such reactor are shown in FIG. 1: the riser reactor comprises the pre-lifting section a, first reaction zone b, second reaction zone c having an enlarged diameter, and outlet zone d having a reduced diameter which are coaxial with each other and arranged from below along the vertical direction in turn; a horizontal pipe e is connected with the end of the outlet zone. The binding site of the first and second reaction zones shows a truncated cone shape, wherein the isosceles trapezoid of the longitudinal profile has an apex angle $\alpha$ of from 30° to 80°; the binding site of the second reaction zone and outlet zone shows a truncated cone shape, wherein the isosceles trapezoid of the longitudinal profile has a base angle $\beta$ of from 45° to 85°.

The sum of the heights of the pre-lifting section, first reaction zone, second reaction zone and outlet zone of the reaction is the total height of the reactor, which is generally from 10 to 60 m.

The diameter of the pre-lifting section is the same as the conventional isodiametric riser reactor, i.e. generally from 0.02 to 5 m, and has a height of 5%-10% of the total height of the reactor. The pre-lifting section has the function of enabling the regenerated catalyst to make the accelerated upward motion in the presence of a pre-lifting medium, wherein the pre-lifting medium is the same as that in the conventional isodiametric riser reactor and selected from steam or dry gas.

The structure of the first reaction zone is similar to the conventional isodiametric riser reactor, wherein the diameter thereof may be identical to or slightly higher than that of the pre-lifting section. The ratio of the diameter of the first reaction zone to the diameter of the pre-lifting section ranges from 1.0 to 2.0:1, and the height thereof ranges from 10 to 30% of the total height of the reactor. The feedstock oil and catalyst are mixed in such zone and primarily cracked at a higher reaction temperature and catalyst/oil ratio and a shorter residence time (generally from 0.5 to 2.5 s).

The second reaction zone is wider than the first reaction zone, wherein the ratio of the diameter of the second reaction zone to the diameter of the first reaction zone ranges from 1.5 to 5.0:1; and the height thereof ranges from 30 to 60% of the total height of the reactor. The second reaction zone is used to reduce the flow rates and reaction temperatures of the oil and gas and the catalyst. The reaction temperature of such zone can be reduced by injecting a quenching medium from the binding site of the second reaction zone and the first reaction zone, and/or setting up a catalyst cooler to withdraw a part of the heat to decrease the reaction temperature of such zone, so as to achieve the object of inhibiting the secondary cracking reaction and increasing the isomerization and hydrogen transfer reactions. The quenching medium is selected from the quenching agent, cooled regenerated catalyst and cooled semi-regenerated catalyst, or mixtures thereof in any ratio, wherein the quenching agent is selected from liquefied petroleum gas, crude gasoline, stabilized gasoline, diesel oil, heavy diesel oil and water, or mixtures thereof in any ratio. The cooled regenerated catalyst and cooled semi-regenerated catalyst are obtained from the spent catalyst to be regenerated by two-stage regeneration and one-stage regeneration respectively. The regenerated catalyst has a carbon content of lower than 0.1 wt. %, preferably lower than 0.05 wt. %; the semi-regenerated catalyst has a carbon content of from 0.1 to 0.9 wt. %, preferably from 0.15 to 0.7 wt. %. If a catalyst cooler is set up, the height thereof is from 50 to 90% of the height of the second reaction zone. The stream may be resided in such reaction zone for a longer period of time, i.e. from 2 to 30 s.

The structure of the outlet zone is similar to the outlet portion at the top of the conventional isodiametric riser reactor, wherein the ratio of the diameter thereof to the diameter of the first reaction zone is 0.8-1.5:1; and the height thereof is from 0 to 20% of the total height of the reactor. The stream may be retained in such zone for a period of time, to inhibit the overcracking and thermalcracking reactions and to increase the flow rate of the fluid.

One end of the horizontal pipe is connected with the outlet zone, and the other end is connected with the disengager. When the height of the outlet zone is 0, i.e. the riser reactor has no outlet zone, one end of the horizontal pipe is connected with the second reaction zone, and the other end is connected with the disengager. The horizontal pipe is used to deliver the products produced by the reaction and the spent catalyst to be regenerated to the separation system for the gas-solid separation. The diameter of the horizontal pipe is determined by those skilled in the art according to the specific circumstances. The pre-lifting section is used to lift the regenerated catalyst in the presence of a pre-lifting medium and to feed the catalyst into the first reaction zone.

In some embodiments in the first and second aspects, the feedstock oil of good quality suitable for the present process may be the petroleum distillates having different boiling ranges. Specifically, the feedstock oil of good quality is one or more selected from atmospheric distillation tower overhead oil, gasoline, catalytic gasoline, diesel oil, vacuum gas oil and hydrogenated vacuum gas oil.

In some embodiments in the first and second aspects, the process is applicable for the same type of catalysts which may be amorphous silica-alumina catalysts or zeolite catalysts. The active components of zeolite catalysts are selected from Y-type zeolites, HY-type zeolites, ultrastable Y-type zeolites, ZSM-5 series of zeolites, and silica-rich zeolites and ferrierites having a five-membered ring structure, or mixtures thereof in any ratio, wherein the zeolites may contain or contain no rare earth and/or phosphorus.

In some embodiments in the first and second aspects, the process is applicable for different types of catalysts having different particle sizes and/or different apparent bulk densities. The active components of the catalysts having different particle sizes and/or different apparent bulk densities are selected from different types of zeolites selected from Y-type zeolites, HY-type zeolites, ultrastable Y-type zeolites, ZSM-5 series of zeolites, and silica-rich zeolites and ferrierites having a five-membered ring structure, or mixtures thereof in any ratio, wherein the zeolites may contain or contain no rare earth and/or phosphorus. The catalysts having different particle sizes and/or different apparent bulk densities may be fed into different reaction zones. For example, the large granular catalyst containing ultrastable Y-type zeolites is fed into the first reaction zone to enhance the cracking reaction; the small granular catalyst containing rare earth Y-type zeolites is fed into the second reaction zone to enhance the hydrogen transfer reaction. The catalysts having different particle sizes are stripped in the same stripper and regenerated in the same regenerator, and then the large granular catalysts are separated from small granular catalysts, wherein the small granular catalysts are cooled and fed into the second reaction zone. The catalysts having different particle sizes are demarcated with 30-40 μm; the catalysts having different apparent bulk densities are demarcated with 0.6~0.7 g/cm$^3$.

In some embodiments in the first and second aspects, the catalyst having a lower activity for which the process is applicable is a catalyst having an activity of from 35 to 55, preferably from 40 to 50. In the previous conventional industrial catalytic cracking operations, a certain amount of catalysts having a high activity (e.g. fresh catalysts, or catalysts having an activity of higher than 60) are generally fed or made-up (supplemented) into the unit. Such catalysts having a lower activity in the reaction device of the present invention can be obtained by, e.g. any of the following methods: reducing the catalyst make-up rate of the unit (i.e. reducing the amount of the make-up catalysts); decreasing the activity of the make-up (or supplemental) catalysts; or decreasing the activity of the catalysts initially fed into the unit. More specifically, the catalysts having a lower activity can be obtained by aging the catalysts with steam at a certain temperature (e.g. from 400 to 850° C.) for a period of time (e.g. from 1 to 720 h)) or by the following processing methods 1, 2 or 3.

The catalyst having a relatively homogeneous activity distribution in the present invention preferably refers to the catalyst, when fed into the catalytic cracking unit, having an initial activity of not higher than 80, not higher than 75 or even not higher than 70, a self-balancing time of from 0.1 to 50 h, from 0.2 to 30 h, or from 0.5 to 10 h, and a equilibrium activity of from 35 to 60 or from 40 to 50. The catalyst having a relatively homogeneous activity distribution can be obtained by the hydrothermal aging treatment, e.g. by the following processing methods 1, 2 and 3.

The term "activity" in the expressions "catalyst having a lower activity" and "catalyst having a relatively homogeneous activity distribution" means the average micro-reaction activity of all the catalysts, rather than the activity of any individual catalyst.

The catalyst activity (e.g. average activity, initial activity, or equilibrium activity) is measured by the measuring method in the prior art: Enterprise standard RIPP 92-90—Micro-reaction activity test method for catalytic cracking, Petrochemical analytic method (RIPP test method), YANG Cuiding et al, 1990 (hereinafter referred to as RIPP 92-90). The activity of the catalyst is represented by light oil micro-reaction activity (MA), calculated by the formula MA=(output of the gasoline having a temperature less than 204° C. in the product+gas output+coke output)/total weight of the feedstock oil*100%=the yield of the gasoline having a temperature less than 204° C. in the product+gas yield+coke yield. The evaluation conditions of the light oil micro-reaction unit (referring to RIPP 92-90) include pulverizing the catalyst into particles having a particle diameter of 420-841 μm; the weight being 5 g; the reaction materials being light diesel fuel having a distillation range of 235-337° C.; the reaction temperature being 460° C.; the weight hourly space velocity being 16 h$^{-1}$; and the catalyst/oil ratio being 3.2.

The self-balancing time of the catalyst is the time necessary for achieving the equilibrium activity by aging at 800° C. and 100% steam (by reference to RIPP 92-90).

The catalyst having a relatively homogeneous activity distribution can be obtained by the hydrothermal aging treatment, e.g. by the following processing methods 1, 2 and 3.

The catalyst-processing method 1:

(1) feeding a fresh catalyst into a fluidized bed, preferably a dense phase fluidized bed, contacting with steam, aging under a certain hydrothermal circumstance to obtain a catalyst having a relatively homogeneous activity; and (2) feeding the catalyst having a relatively homogeneous activity into a regenerator of an industrial catalytic cracking unit.

The processing method 1 is specifically carried out, for example, as follows.

A fresh catalyst is fed into a fluidized bed, preferably a dense phase fluidized bed, and steam is fed into the bottom of the fluidized bed. The fluidization of the catalyst is achieved under the action of steam, and the catalyst is aged by steam at the same time to obtain the catalyst having a relatively homogeneous activity. The aging temperature ranges from 400° C. to 850° C., preferably from 500° C. to 750° C., more preferably from 600° C. to 700° C. The superficial linear velocity of the fluidized bed ranges from 0.1 to 0.6 m/s, preferably from 0.15 to 0.5 m/s. The aging time ranges from 1 to 720 h, preferably from 5 to 360 h. According to the requirements on the industrial catalytic cracking unit, the catalyst having a relatively homogeneous activity is fed into the regenerator of the industrial catalytic cracking unit to obtain said hot regenerated catalyst having a relatively homogeneous activity distribution.

The catalyst-processing method 2:

1) feeding a fresh catalyst into a fluidized bed, preferably a dense phase fluidized bed, contacting with a mixture of steam and other aging media, aging under a certain hydrothermal circumstance to obtain a catalyst having a relatively homogeneous activity; and (2) feeding the catalyst having a relatively homogeneous activity into a regenerator of an industrial catalytic cracking unit.

The technical solution of the processing method 2 is specifically carried out, for example, as follows.

A fresh catalyst is fed into a fluidized bed, preferably a dense phase fluidized bed, and the mixture of steam and other aging media is fed into the bottom of the fluidized bed. The fluidization of the catalyst is achieved under the action of the mixture of steam and other aging media, and the catalyst is aged by the mixture of steam and other aging media at the same time to obtain the catalyst having a relatively homogeneous activity. The aging temperature ranges from 400° C. to 850° C., preferably from 500° C. to 750° C., more preferably from 600° C. to 700° C. The superficial linear velocity of the fluidized bed ranges from 0.1 to 0.6 m/s, preferably from 0.15 to 0.5 m/s. The weight ratio of steam to the other aging medium ranges from 0.20 to 0.9, preferably from 0.40 to 0.60. The aging time ranges from 1 to 720 h, preferably from 5 to 360 h. According to the requirements on the industrial unit, the catalyst having a relatively homogeneous activity is fed into the regenerator of the industrial catalytic cracking unit to obtain said hot regenerated catalyst having a relatively homogeneous activity distribution. Said other aging media comprise air, dry gas, regenerated flue gas, gas obtained by combusting air and dry gas or gas obtained by combusting air and burning oil, or other gases such as nitrogen gas. The weight ratio of steam and other aging media ranges from 0.2 to 0.9, preferably from 0.40-0.60.

The Catalyst-Processing Method 3:

(1) feeding a fresh catalyst into a fluidized bed, preferably a dense phase fluidized bed, feeding the hot regenerated catalyst in the regenerator into another fluidized bed, and solid-solid heat exchanging the fresh catalyst and the hot regenerated catalyst in two fluidized beds;

(2) contacting the heat exchanged fresh catalyst with steam or a mixture of steam and other aging media, aging under a certain hydrothermal circumstance to obtain a catalyst having a relatively homogeneous activity; and (3) feeding the catalyst having a relatively homogeneous activity into a regenerator of an industrial catalytic cracking unit.

The technical solution of the present invention is specifically carried out, for example, as follows.

A fresh catalyst is fed into a fluidized bed, preferably a dense phase fluidized bed, and the hot regenerated catalyst in the regenerator is fed into another fluidized bed at the same time to heat exchange in two fluidized beds. Steam or a mixture of steam and other aging media is fed into the bottom of the fluidized bed containing fresh catalyst. The fluidization of the fresh catalyst is achieved under the action of steam or the mixture of steam and other aging media, and the fresh catalyst is aged by steam or the mixture of steam and other aging media at the same time to obtain the aged catalyst having a relatively homogeneous activity. The aging temperature ranges from 400° C. to 850° C., preferably from 500° C. to 750° C., more preferably from 600° C. to 700° C. The superficial linear velocity of the fluidized bed ranges from 0.1 to 0.6 m/s, preferably from 0.15 to 0.5 m/s. The aging time ranges from 1 to 720 h, preferably from 5 to 360 h. Under the circumstance of the mixture of steam with other aging media, the weight ratio of steam to the other aging medium is greater than 0-4, preferably ranges from 0.5 to 1.5. According to the requirements on the industrial catalytic cracking unit, the aged catalyst is fed into the regenerator of the industrial catalytic cracking unit to obtain said hot regenerated catalyst having a relatively homogeneous activity distribution. In addition, steam after the aging step is fed into the reaction system (as one or more selected from the group consisting of stripping steam, anti-coking steam, atomizing steam and lifting steam, and respectively fed into the stripper, disengager, feedstock nozzle and prelifting zone of the catalytic cracking unit) or the regeneration system. The mixture of steam and other aging media after the aging step is fed into the regeneration system, and the heat exchanged regenerated catalyst is recycled back to the regenerator. Other aging media comprise air, dry gas, regenerated flue gas, gas obtained by combusting air and dry gas or gas obtained by combusting air and burning oil, or other gases such as nitrogen gas. Such regenerated flue gas may be derived from the present unit, or other units.

By hydrothermally aging treatment, the activity and selectivity distributions of the catalysts in the industrial reaction device becomes more homogeneous, and the catalyst selectivity is obviously improved so as to obviously reduce the dry gas yield and coke yield.

The advantages of the present invention lie in:

1. If the present invention is carried out by using the conventional isodiametric riser or fluidized bed reactor, it can be implemented merely by reducing the processing amount and prolonging the reaction time.

2. If the riser reactor with varied diameters is used, such reactor has the advantages of not only retaining a higher temperature at the bottom of the conventional riser reactor and catalyst/oil ratio to add an extra cracking reaction and inhibiting the overcracking and thermal cracking reactions at the top thereof at the same time, but also prolonging the reaction time at a lower reaction temperature at the medium and upper parts of the reactor to add the isomerization and hydrogen migration reactions of olefins.

3. In the liquefied petroleum gas produced by the process provided in the present invention, the isobutene content is increased by a factor of more than 30%, as compared with a conventional process, and the olefin content in the gasoline composition may be increased to more than 30 wt. %.

As used herein, the singular form "a", "an" and "the" include plural references unless the context clearly dictates otherwise.

EMBODIMENTS

Figure 1:
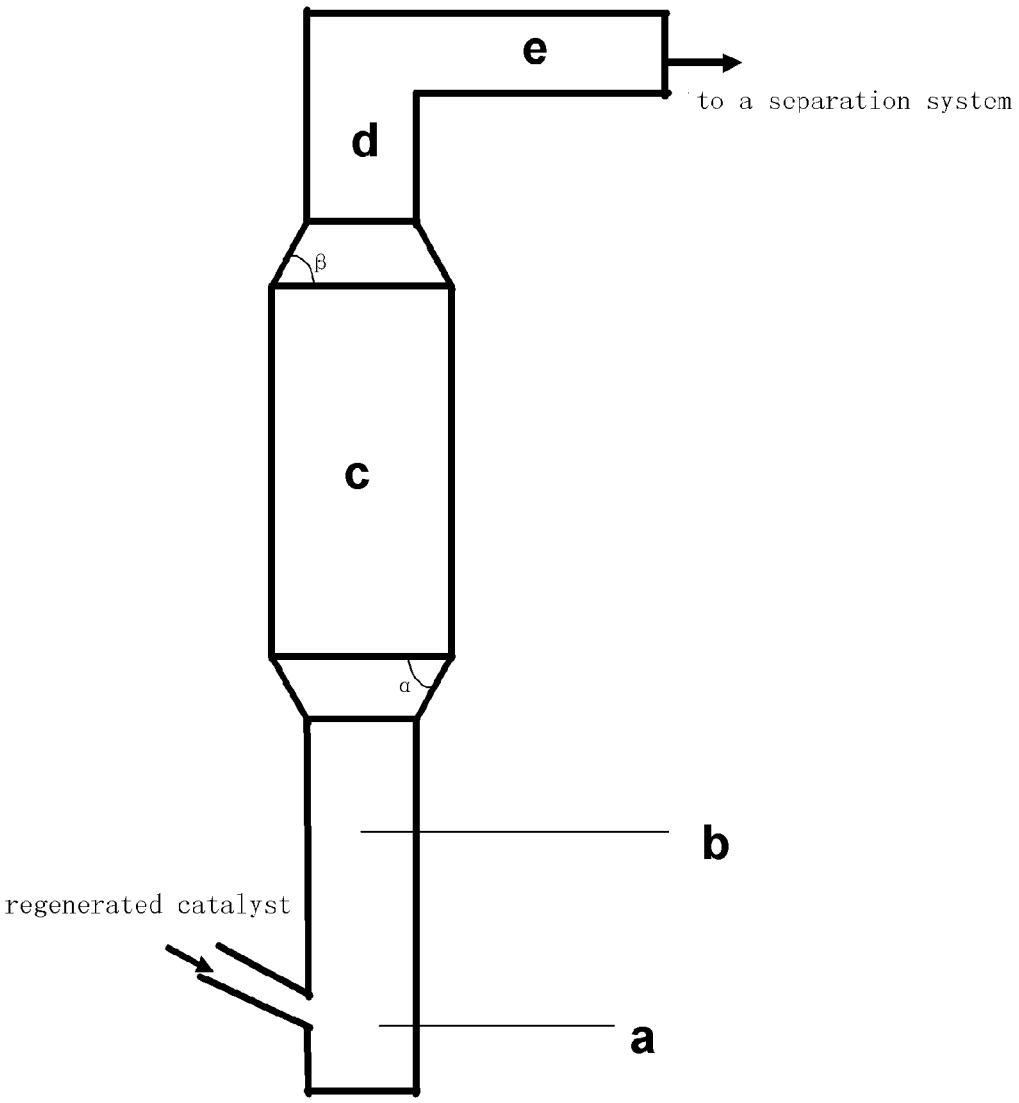
FIG. 1 represents the schematic diagram of the riser reactor, wherein a, b, c, d and e therein respectively represent the pre-lifting section, first reaction zone, second reaction zone, outlet zone and horizontal tube.

The present invention has different embodiments, e.g.

Embodiment 1

At the bottom of the conventional isodiametric riser reactor, the preheated feedstock oil contacts and cracks with a hot regenerated catalyst having a lower activity or a hot regenerated catalyst having a lower activity and a relatively homogeneous activity distribution. The resultant oil and gas and the used catalyst go upward and contact with the cooled regenerated catalyst fed therein, and subsequently the isomerization and hydrogen transfer reactions take place. After the reaction, the effluent enters the disengager. The reaction product is separated, and the spent catalyst to be regenerated is stripped, regenerated and divided into two parts, wherein one part enters the bottom of the reactor, and the other is cooled and fed into the medium and lower parts of the reactor.

Embodiment 2

At the bottom of the conventional isodiametric riser reactor, the preheated feedstock oil contacts and cracks with a hot regenerated catalyst having a lower activity or a hot regenerated catalyst having a lower activity and a relatively homogeneous activity distribution. The resultant oil and gas and the used catalyst go upward and contact with a quenching agent and cooled semi-regenerated catalyst, and subsequently the isomerization and hydrogen transfer reactions take place. After the reaction, the effluent enters the disengager. The reaction product is separated, and the spent catalyst to be regenerated is stripped, fed into a two-stage regenerator and coked, wherein the semi-regenerated catalyst from the first stage regenerator is cooled and fed into the medium and lower parts of the reactor; and the regenerated catalyst from the second stage regenerator is directly fed into the bottom of the reactor without cooling.

Embodiment 3

In a catalytic cracking unit having a conventional riser-fluidized bed reactor, the preheated conventional cracking feedstock is fed from the lower part of the riser and contacts with a hot regenerated catalyst having a lower activity or a hot regenerated catalyst having a lower activity and a relatively homogeneous activity distribution. The resultant oil and gas goes upward to the top of the riser, and contacts and continues to react with the cooled catalyst. After the reaction, the effluent enters the disengager. The reaction product is separated, and the spent catalyst to be regenerated is stripped, regenerated and divided into two parts, wherein one part enters the lower part of the reactor, and the other is cooled and fed into the top of the reactor.

Embodiment 4

This embodiment is the best embodiment of the present invention.

In a catalytic cracking unit having a riser reactor with varied diameters, the preheated conventional cracking feedstock is fed from the lower part of the first reaction zone of the reactor, and contacts and cracks with a hot regenerated catalyst having a lower activity or a hot regenerated catalyst having a lower activity and a relatively homogeneous activity distribution. The resultant oil and gas goes upward to the lower part of the second reaction zone of the reactor, and contacts with the cooled catalyst, so that the hydrogen transfer and isomerization reactions take place. After the reaction, the effluent enters the disengager. The reaction product is separated, and the spent catalyst to be regenerated is stripped, regenerated and fed into the lower part of the second reaction zone.

The process provided in the present invention is not limited to the embodiments above.

The process provided in the present invention is further stated by reference to the drawings, but the present invention will not be limited thereby.

Figure 2:
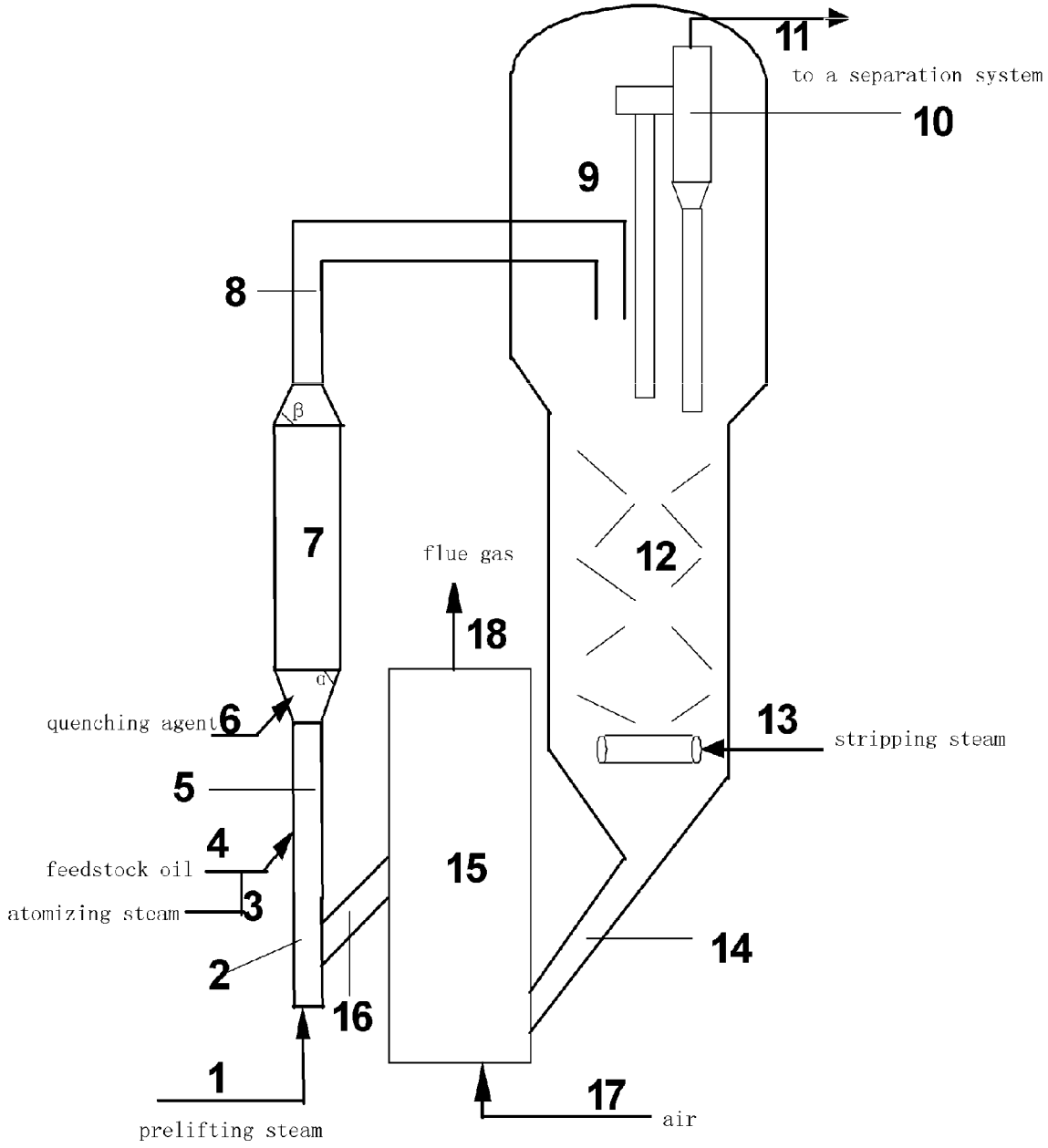
FIG. 2 represents the flow chart of the best embodiment in the second aspect of the present invention. The reference signs in FIG. 2 are stated as follows: 1, 3, 4, 6, 11, 13, 17 and 18 all represent the pipelines; 2 represents the pre-lifting section of the riser; 5 and 7 respectively represent the first and second reaction zones of the riser; 8 represents the outlet zone of the riser; 9 represents the disengager; 10 represents the cyclone separator; 12 represents the stripper; 14 represents the sloped pipe for the spent catalyst to be regenerated; 15 represents the regenerator; 16 represents the sloped pipe for the regenerated catalyst.

FIG. 2 represents the flow scheme of the catalytic conversion process for increasing the isobutene content in the liquefied petroleum gas and the gasoline olefin content by using a riser reactor with varied diameters, wherein the shapes and sizes of the device and pipelines are determined according to the specific conditions without any limitation by the drawings.

The pre-lifting vapor is fed from the pre-lifting section 2 of the riser via pipeline 1. The hot regenerated catalyst having a lower activity or the hot regenerated catalyst having a lower activity and a relatively homogeneous activity distribution is fed into the pre-lifting section of the riser via the sloped pipe 16 for the regenerated catalyst and lifted by the pre-lifting vapor. From the pre-lifting section of the riser, the pre-heated feedstock oil is fed via pipeline 4 together with the atomizing steam from pipeline 3 in a certain ratio, mixed with the hot catalyst, fed into the first reaction zone 5 and cracked under certain conditions. The reaction stream and the quenching agent from pipeline 6 and/or cooled catalyst (which are not marked out in the figure) are mixed and fed into the second reaction zone 7 for the secondary reaction. The reacted stream is fed into the outlet zone 8 in which the linear velocity of the stream increased so as to enable the reaction stream to be fed into the disengager 9 and cyclone separator 10, and the reaction product is sent to a separation system via the pipeline 11. After the reaction, the spent catalyst to be regenerated and carrying coke is fed into the stripper 12, stripped by steam from pipeline 13, and fed into the regenerator 15 via the sloped pipe 14 for the spent catalyst to be regenerated. The spent catalyst to be regenerated is coked and regenerated in the air from pipeline 17, wherein the flue gas is removed from the regenerator via pipeline 18; and the hot regenerated catalyst is recycled to the bottom of the riser via the sloped pipe 16 for the regenerated catalyst.

EXAMPLES

The following examples are used to demonstrate the present invention, but are not meant to limit the scope of the invention. The properties of the feedstock oils and catalysts used in the examples and comparison examples are respectively listed in Tables 1 and 2. The catalysts in Table 2 are both produced by Qilu Catalyst Factory of SINOPEC. ZCM-7 catalyst in Table 2 is aged at 800° C. with 100% steam for 12 h and 30 h respectively, to obtain two ZCM-7 catalysts having different activity levels, i.e. 67 and 45. Likewise, CGP-1 catalyst in Table 2 is aged at 800° C. with 100% steam for 12 h and 30 h respectively, to obtain two CGP-1 catalysts having different activity levels, i.e. 62 and 50.

Example 1

This example illustrates the circumstance of increasing the isobutene content in the LPG (Liquefied Petroleum Gas)

and the olefin content in the gasoline in a medium-scale riser reactor with varied diameters by using the process provided in the present invention and the catalysts having different activity levels.

The total height of the pre-lifting section, first reaction zone, second reaction zone, and outlet zone of the reactor was 15 m, wherein the pre-lifting section had a diameter of 0.025 m and a height of 1.5 m; the first reaction zone had a diameter of 0.025 m and a height of 4 m; the second reaction zone had a diameter of 0.1 m and a height of 6.5 m; and the outlet zone had a diameter of 0.025 m and a height of 3 m. The isosceles trapezoid of the longitudinal profile of the binding site of the first and second reaction zones, had an apex angle of 45°; the isosceles trapezoid of the longitudinal profile of the binding site of the second reaction zone and the outlet zone, had a base angle of 60°.

The preheated feedstock oil B listed in Table 1 was fed into the reactor, contacted and reacted with the hot catalyst ZCM-7 listed in Table 2 in the presence of steam, wherein the ZCM-7 catalyst had an activity of 45. The reaction product was separated to obtain a LPG and gasoline, as well as other products; the spent catalyst to be regenerated was stripped and fed into the regenerator; the regenerated catalyst was coked and recycled.

The operation conditions of the test, the production distribution and the properties of gasoline are listed in Table 3.

Comparison Example 1

The reactor model and operation conditions used therein were completely the same as those in Example 1; the feedstock oil used therein was also the feedstock oil B listed in Table 1; the catalyst used therein was also the catalyst ZCM-7 listed in Table 2, except that the ZCM-7 catalyst had an activity of 67 at this time. The operation conditions of the test, the production distribution and the properties of gasoline are listed in Table 3.

According to Table 3, it can be seen that, as compared with ZCM-7 having a higher activity (i.e. having an activity of 67), the isobutene yield obtained by using ZCM-7 having a lower activity (i.e. having an activity of 45) is increased from 1.4 wt. % to 2.0 wt. % (increased by a factor of 42.86%); the olefin content in the gasoline is increased from 16.3 wt. % to 29.3 wt. %. In addition, the liquid yield is still increased by 1.2% by weight.

Example 2

This example illustrates the circumstance of increasing the isobutene content in the LPG and the olefin content in the gasoline in a medium-scale riser reactor with varied diameters by using the process provided in the present invention and the catalysts having different activity levels.

The total height of the pre-lifting section, first reaction zone, second reaction zone, and outlet zone of the reactor was 15 m, wherein the pre-lifting section had a diameter of 0.025 m and a height of 1.5 m; the first reaction zone had a diameter of 0.025 m and a height of 4 m; the second reaction zone had a diameter of 0.1 m and a height of 6.5 m; and the outlet zone had a diameter of 0.025 m and a height of 3 m. The isosceles trapezoid of the longitudinal profile of the binding site of the first and second reaction zones, had an apex angle of 45°; the isosceles trapezoid of the longitudinal profile of the binding site of the second reaction zone and the outlet zone, had a base angle of 60°.

The preheated feedstock oil B listed in Table 1 was fed into the reactor, contacted and reacted with the hot catalyst CGP-1 listed in Table 2 in the presence of steam, wherein the CGP-1 catalyst had an activity of 50. The reaction product was separated to obtain a LPG and gasoline, as well as other products; the spent catalyst to be regenerated was stripped and fed into the regenerator; the regenerated catalyst was coked and recycled.

The operation conditions of the test, the production distribution and the properties of gasoline are listed in Table 4.

Comparison Example 2

The reactor model and operation conditions used therein were completely the same as those in Example 2; the feedstock oil used therein was also the feedstock oil B listed in Table 1; the catalyst used therein was also the catalyst CGP-1 listed in Table 2, except that the CGP-1 catalyst had an activity of 62 at this time. The operation conditions of the test, the production distribution and the properties of gasoline are listed in Table 4.

According to Table 4, it can be seen that, as compared with CGP-1 having a higher activity (i.e. having an activity of 62), the isobutene yield obtained by using CGP-1 having a lower activity (i.e. having an activity of 50) is increased from 3.0 wt. % to 4.1 wt. % (increased by a factor of 36.67%); the olefin content in the gasoline is increased from 18.2 wt. % to 27.9 wt. %. In addition, the liquid yield is still increased by 0.8% by weight.

Examples 3 and 4

This example illustrates the circumstance of increasing the isobutene content in the LPG and the olefin content in the gasoline in a medium-scale riser reactor with varied diameters by using the process provided in the present invention and different catalytic cracking feedstock oils.

The reactor, catalyst type, and catalyst activity used in these Examples were the same as those in Example 2, except that the feedstock oils were respectively the feedstock oils A and C listed in Table 1.

The operation conditions of the test, the production distribution and the properties of gasoline are listed in Table 5. According to Table 5, it can be seen that the isobutene yields are respectively 4.3 wt. % and 2.1 wt. %; the olefin contents in the gasoline are respectively 30.2 wt. % and 22.2 wt. %.

Example 5

This example illustrates the circumstance of increasing the isobutene content in the LPG and the olefin content in the gasoline in a medium-scale riser reactor with varied diameters by using the process provided in the present invention and the catalysts having different activity levels.

The total height of the pre-lifting section, first reaction zone, second reaction zone, and outlet zone of the reactor was 15 m, wherein the pre-lifting section had a diameter of 0.025 m and a height of 1.5 m; the first reaction zone had a diameter of 0.025 m and a height of 4 m; the second reaction zone had a diameter of 0.1 m and a height of 6.5 m; and the outlet zone had a diameter of 0.025 m and a height of 3 m. The isosceles trapezoid of the longitudinal profile of the binding site of the first and second reaction zones, had an apex angle of 45°; the isosceles trapezoid of the longitudinal profile of the binding site of the second reaction zone and the outlet zone, had a base angle of 60°.

The preheated feedstock oil B was fed into the reactor, contacted and reacted with the hot catalyst ZCM-7 in the presence of steam, wherein the ZCM-7 catalyst had an activity (average activity) of 45. The reaction product was separated to obtain a LPG and gasoline, as well as other products; the spent catalyst to be regenerated was stripped and fed into the regenerator; the regenerated catalyst was coked and recycled. The ZCM-7 catalyst made-up (supplemented) into the unit was the catalyst obtained by hydrothermally treating fresh ZCM-7 (the hydrothermal treatment of the catalyst was conducted by the catalyst-processing method 1 of the present invention: a dense phase fluidized bed, an aging temperature of 650° C., and an apparent linear velocity of the fluidized bed of 0.30 m/s, 100% steam, and an aging time of 31 h), which had an initial activity of 75. Then the made-up ZCM-7 catalyst was mixed with the equilibrium catalyst in the unit, and then hydrothermally aged in the unit. As for the made-up catalyst, the self-balancing time required to achieve the catalyst equilibrium activity of 45 in the unit was 30 h.

The operation conditions of the test, the production distribution and the properties of gasoline are listed in Table 6.

Example 5A

The reactor type and operation conditions were the same as those in Example 5; the feedstock oil used therein was also the feedstock oil B listed in Table 1; the catalyst used therein was also the catalyst ZCM-7 listed in Table 2 and also had an average catalyst activity of 45, except that the ZCM-7 catalyst made-up into the unit was the fresh ZCM-7 catalyst which was not hydrothermally processed and had an initial activity of 91. Then the fresh ZCM-7 catalyst was mixed with the equilibrium catalyst in the unit, and then hydrothermally aged in the unit till the catalyst equilibrium activity in the unit achieved 45. The operation conditions of the test, the production distribution and the properties of gasoline are listed in Table 6.

According to Table 6, it can be seen that, as compared with the unprocessed ZCM-7 catalyst, the dry gas yield obtained by adding the processed ZCM-7 catalyst is decreased from 1.7 wt. % to 1.5 wt. %; the coke yield is decreased from 3.2 wt. % to 2.7 wt. %; the liquid yield is increased from 89.3 wt. % to 89.8 wt. % (increased by 0.5%); their isobutene yields and gasoline olefin contents are substantially the same.

Example 6

This example illustrates the circumstance of increasing the isobutene content in the LPG and the olefin content in the gasoline in a medium-scale riser reactor with varied diameters by using the process provided in the present invention and the catalysts having different activity levels.

The total height of the pre-lifting section, first reaction zone, second reaction zone, and outlet zone of the reactor was 15 m, wherein the pre-lifting section had a diameter of 0.025 m and a height of 1.5 m; the first reaction zone had a diameter of 0.025 m and a height of 4 m; the second reaction zone had a diameter of 0.1 m and a height of 6.5 m; and the outlet zone had a diameter of 0.025 m and a height of 3 m. The isosceles trapezoid of the longitudinal profile of the binding site of the first and second reaction zones, had an apex angle of 45°; the isosceles trapezoid of the longitudinal profile of the binding site of the second reaction zone and the outlet zone, had a base angle of 60°.

The preheated feedstock oil B was fed into the reactor, contacted and reacted with the hot catalyst CGP-1 in the presence of steam, wherein the CGP-1 catalyst had an average activity of 50. The reaction product was separated to obtain a LPG and gasoline, as well as other products; the spent catalyst to be regenerated was stripped and fed into the regenerator; the regenerated catalyst was coked and recycled. The CGP-1 catalyst made-up into the unit was the catalyst obtained by hydrothermally treating fresh CGP-1 (the hydrothermal treatment of the catalyst was conducted by the catalyst-processing method 1 of the present invention: a dense phase fluidized bed, an aging temperature of 670° C., and an apparent linear velocity of the fluidized bed of 0.30 m/s, 100% steam, and an aging time of 28 h) and having an initial activity of 72. Then the made-up CGP-1 catalyst was mixed with the equilibrium catalyst in the unit, and then hydrothermally aged in the unit. As for the made-up catalyst, the self-balancing time (800° C. and 100% steam) required to achieve the catalyst equilibrium activity of 50 in the unit was 40 h.

The operation conditions of the test, the production distribution and the properties of gasoline are listed in Table 7.

Example 6A

The reactor type and operation conditions were the same as those in Example 6; the feedstock oil used therein was also the feedstock oil B listed in Table 1; the catalyst used therein was also the catalyst CGP-1 listed in Table 2 and also had an average activity of 50, except that the CGP-1 catalyst made-up into the unit was the fresh CGP-1 catalyst which was not hydrothermally processed and had an initial activity of 95. Then the fresh CGP-1 catalyst was mixed with the equilibrium catalyst in the unit, and then hydrothermally aged in the unit till the catalyst equilibrium activity in the unit achieved 50. The operation conditions of the test, the production distribution and the properties of gasoline are listed in Table 7.

According to Table 7, it can be seen that, as compared with the unprocessed CGP-1 catalyst, the dry gas yield obtained by adding the processed CGP-1 catalyst is decreased from 2.0 wt. % to 1.9 wt. %; the coke yield is decreased from 3.0 wt. % to 2.5 wt. %; the liquid yield is increased from 88.7 wt. % to 89.3 wt. % (increased by 0.6%); their isobutene yields and gasoline olefin contents are substantially the same.

Example 7

This example illustrates the circumstance of improving the product distribution by using the process provided in the present invention, the catalysts having different activity levels and the medium-scale conventional isodiametric riser reactor.

The preheated feedstock oil B listed in Table 1 was fed into the reactor, contacted and reacted with the hot catalyst ZCM-7 listed in Table 2 in the presence of steam, wherein the ZCM-7 catalyst had an activity of 45. The reaction product was separated to obtain a LPG and gasoline, as well as other products; the spent catalyst to be regenerated was stripped and fed into the regenerator; the regenerated catalyst was coked and recycled.

The operation conditions of the test, the production distribution and the properties of gasoline are listed in Table 8.

Comparison Example 3

The reactor model and operation conditions used therein were completely the same as those in Example 7; the feedstock oil used therein was also the feedstock oil B listed in Table 1; the catalyst used therein was also the catalyst ZCM-7 listed in Table 2, except that the ZCM-7 catalyst had an activity of 67 at this time. The operation conditions of the test, the production distribution and the properties of gasoline are listed in Table 8.

According to Table 8, it can be seen that, as compared with ZCM-7 having a higher activity (i.e. having an activity of 67), the isobutene yield obtained by using ZCM-7 having a lower activity (i.e. having an activity of 45) is increased from 1.4 wt. % to 1.9 wt. % (increased by 0.5 percent %); the olefin content in the gasoline is increased from 25.6 wt. % to 31.7 wt. %. In addition, the liquid yield is still increased by 0.9%.

TABLE 1

| | Feedstock oil No. | | |
|---|---|---|---|
| | A | B | C |
| | Names of feedstock oil | | |
| | vacuum gas oil | Hydrogenated vacuum gas oil | Hydrogenated vacuum gas oil |
| Density (20° C.), kg/m$^3$ | 890.5 | 899.3 | 911.9 |
| Kinematic viscosity, mm$^2$/s | | | |
| 80° C. | 7.93 | 16.22 | 6.62 |
| 100° C. | 5.08 | 9.29 | 4.30 |
| Carbon residue, wt. % | 0.7 | 0.30 | 0.17 |
| Solidifying point, ° C. | 40 | 44 | 16 |
| Basic nitrogen, ppm | | 293 | 4 |
| Total nitrogen, wt. % | 0.16 | 0.08 | 0.011 |
| Sulfur, wt. % | 0.53 | 0.12 | 0.017 |
| Carbon, wt. % | 85.00 | 87.01 | 87.55 |
| Hydrogen, wt. % | 12.62 | 12.85 | 12.35 |
| Distillation range, ° C. | | | |
| Initial boiling point | 242 | 284 | 204 |
| 10% | 322 | 394 | 290 |
| 30% | 380 | 433 | 363 |
| 50% | 410 | 463 | 406 |
| 70% | 437 | 495 | 438 |
| 90% | 480 | / | 490 |
| Final boiling point | 516 | / | / |

TABLE 2

| | Catalyst No. | |
|---|---|---|
| | A | B |
| Commodity brand | ZCM-7 | CGP-1 |
| Zeolite type | USY | REY-USY-ZRP |
| Chemical composition, wt. % | | |
| Alumina | 46.4 | 52.0 |
| Sodium oxide | 0.22 | 0.14 |
| Iron oxide | 0.32 | 0.30 |
| Apparent density, kg/m$^3$ | 600 | 740 |
| Pore volume, ml/g | 0.32 | 0.37 |
| Specific surface area, m$^2$/g | 217 | 263 |
| Particle Size Distribution, wt. % | | |
| 0-40 μm | 16.1 | 20.3 |
| 40-80 μm | 54.1 | / |
| >80 μm | 29.8 | / |

TABLE 3

| | Example 1 | Com. Example 1 |
|---|---|---|
| ZCM-7 catalyst activity | 45 | 67 |
| Reaction temperature, ° C. | | |
| In the first reaction zone | 550 | 550 |
| In the second reaction zone | 500 | 500 |
| Residence time, s | 5.5 | 5.5 |
| In the first reaction zone | 2.0 | 2.0 |
| In the second reaction zone | 3.5 | 3.5 |
| Catalyst/oil ratio | 5.0 | 5.0 |
| Steam/oil ratio | 0.1 | 0.1 |

TABLE 3-continued

| | Example 1 | Com. Example 1 |
|---|---|---|
| Production distribution, wt. % | | |
| Dry gas | 1.4 | 1.8 |
| LPG | 17.3 | 17.5 |
| Isobutene in the LPG | 2.0 | 1.4 |
| Gasoline | 55.0 | 56.0 |
| Diesel oil | 17.8 | 15.4 |
| Heavy oil | 6.0 | 5.6 |
| Coke | 2.5 | 3.7 |
| Liquid yield, wt. % | 90.1 | 88.9 |
| Octane number | | |
| RON | 91.0 | 90.6 |
| MON | 80.7 | 80.5 |
| Distillation range, ° C. | | |
| IBP (initial boiling point)-FBP (final boiling point) | 38-200 | 37-200 |
| Gasoline composition, wt. % | | |
| Paraffins | 40.5 | 50.6 |
| Naphthenes | 7.3 | 8.2 |
| Olefins | 29.3 | 16.3 |
| Aromatics | 22.9 | 24.9 |

TABLE 4

| | Example 2 | Com. Example 2 |
|---|---|---|
| CGP-1 catalyst activity | 50 | 62 |
| Reaction temperature, ° C. | | |
| In the first reaction zone | 550 | 550 |
| In the second reaction zone | 505 | 505 |
| Catalyst/oil ratio | 6.0 | 6.0 |
| Reaction time, s | 6.0 | 6.0 |
| In the first reaction zone | 1.3 | 1.3 |
| In the second reaction zone | 4.7 | 4.7 |
| Steam/oil ratio | 0.1 | 0.1 |
| Production distribution, wt. % | | |
| Dry gas | 1.8 | 2.1 |
| LPG | 28.5 | 29.1 |
| Propylene in the LPG | 10.6 | 9.4 |
| Isobutene in the LPG | 4.1 | 3.0 |
| Gasoline | 42.9 | 43.0 |
| Diesel oil | 18.0 | 16.5 |
| Heavy oil | 6.5 | 6.0 |
| Coke | 2.3 | 3.3 |
| Liquid yield, wt. % | 89.4 | 88.6 |
| Octane number of gasoline | | |
| RON | 93.5 | 93.2 |
| MON | 81.5 | 81.5 |
| Distillation range, ° C. | | |
| IBP-FBP | 38-200 | 37-200 |
| Gasoline composition, wt. % | | |
| Paraffins | 35.9 | 41.7 |
| Naphthenes | 7.6 | 8.0 |
| Olefins | 27.9 | 18.2 |
| Aromatics | 28.6 | 32.1 |

TABLE 5

| | Example 3 | Example 4 |
|---|---|---|
| Feedstock oil | A | C |
| Operation conditions | | |
| Reaction temperature, ° C. | | |
| In the first reaction zone | 550 | 550 |
| In the second reaction zone | 505 | 505 |
| Catalyst/oil ratio | 6.0 | 6.0 |

TABLE 5-continued

| | Example 3 | Example 4 |
|---|---|---|
| Reaction time, s | 6.0 | 6.0 |
| In the first reaction zone | 1.3 | 1.3 |
| In the second reaction zone | 4.7 | 4.7 |
| Steam/oil ratio | 0.1 | 0.1 |
| Production distribution, wt. % | | |
| Dry gas | 1.7 | 2.0 |
| LPG | 28.0 | 24.0 |
| propylene in the LPG | 10.5 | 7.5 |
| Isobutene in the LPG | 4.3 | 2.1 |
| Gasoline | 42.0 | 46.6 |
| Diesel oil | 18.6 | 17.0 |
| Heavy oil | 6.9 | 7.5 |
| Coke | 2.8 | 2.9 |
| Liquid yield, wt. % | 88.6 | 87.6 |
| Octane number of gasoline | | |
| RON | 93.2 | 93.0 |
| MON | 81.2 | 81.1 |
| Distillation range, ° C. | | |
| IBP-FBP | 38~200 | 38~200 |
| Gasoline composition, wt. % | | |
| Paraffins | 35.4 | 41.9 |
| Naphthenes | 7.8 | 8.3 |
| Olefins | 30.2 | 22.2 |
| Aromatics | 26.6 | 27.6 |

TABLE 6

| | Example 5 | Example 5A |
|---|---|---|
| ZCM-7 catalyst activity | 45 | 45 |
| Catalyst activity distribution | 40-75 | 40-91 |
| Reaction temperature, ° C. | | |
| In the first reaction zone | 550 | 550 |
| In the second reaction zone | 500 | 500 |
| Residence time, s | 5.5 | 5.5 |
| In the first reaction zone | 2.0 | 2.0 |
| In the second reaction zone | 3.5 | 3.5 |
| Catalyst/oil ratio | 5.0 | 5.0 |
| Steam/oil ratio | 0.1 | 0.1 |
| Production distribution, wt. % | | |
| Dry gas | 1.5 | 1.7 |
| LPG | 17.2 | 17.5 |
| Isobutene in the LPG | 2.0 | 1.9 |
| Gasoline | 55.0 | 55.4 |
| Diesel oil | 17.6 | 16.4 |
| Heavy oil | 6.0 | 5.8 |
| Coke | 2.7 | 3.2 |
| Liquid yield, wt. % | 89.8 | 89.3 |
| Octane number | | |
| RON | 91.2 | 91.0 |
| MON | 80.7 | 80.5 |
| Distillation range, ° C. | | |
| IBP-FBP | 38-200 | 37-200 |
| Gasoline composition, wt. % | | |
| Paraffins | 40.0 | 40.3 |
| Naphthenes | 7.5 | 8.2 |
| Olefins | 29.8 | 28.4 |
| Aromatics | 22.7 | 23.1 |

TABLE 7

| | Example 6 | Example 6A |
|---|---|---|
| CGP-1 catalyst activity | 50 | 50 |
| Catalyst activity distribution | 43-72 | 43-95 |

TABLE 7-continued

| | Example 6 | Example 6A |
|---|---|---|
| Reaction temperature, ° C. | | |
| In the first reaction zone | 550 | 550 |
| In the second reaction zone | 505 | 505 |
| Catalyst/oil ratio | 6.0 | 6.0 |
| Reaction time, s | 6.0 | 6.0 |
| In the first reaction zone | 1.3 | 1.3 |
| In the second reaction zone | 4.7 | 4.7 |
| Steam/oil ratio | 0.1 | 0.1 |
| Production distribution, wt. % | | |
| Dry gas | 1.9 | 2.0 |
| LPG | 28.7 | 28.9 |
| propylene in the LPG | 10.5 | 10.0 |
| Isobutene in the LPG | 4.0 | 3.9 |
| Gasoline | 42.4 | 42.8 |
| Diesel oil | 18.2 | 17.0 |
| Heavy oil | 6.3 | 6.3 |
| Coke | 2.5 | 3.0 |
| Liquid yield, wt. % | 89.3 | 88.7 |
| Octane number of gasoline | | |
| RON | 93.4 | 93.2 |
| MON | 81.3 | 81.5 |
| Distillation range, ° C. | | |
| IBP-FBP | 38-200 | 38-200 |
| Gasoline composition, wt. % | | |
| Paraffins | 36.3 | 36.5 |
| Naphthenes | 7.7 | 8.0 |
| Olefins | 27.2 | 26.5 |
| Aromatics | 28.8 | 29.0 |

TABLE 8

| | Example 7 | Com. Example 3 |
|---|---|---|
| ZCM catalyst activity | 45 | 67 |
| Reaction temperature, ° C. | 520 | 520 |
| Catalyst/oil ratio | 6.0 | 6.0 |
| Reaction time, s | 4.5 | 4.5 |
| Steam/oil ratio | 0.1 | 0.1 |
| Product distribution, wt. % | | |
| Dry gas | 2.3 | 2.6 |
| LPG | 15.3 | 15.6 |
| Isobutene in the LPG | 1.9 | 1.4 |
| Gasoline | 49.3 | 50.1 |
| Diesel oil | 20.6 | 18.6 |
| Heavy oil | 9.8 | 9.1 |
| Coke | 2.7 | 4.0 |
| Liquid yield, wt. % | 85.2 | 84.3 |
| Octane number of gasoline | | |
| RON | 90.6 | 90.1 |
| MON | 79.8 | 79.7 |
| Distillation range, ° C. | | |
| IBP-FBP | 38-200 | 38-200 |
| Gasoline composition, wt. % | | |
| Paraffins | 41.7 | 46.5 |
| Naphthenes | 7.6 | 8.0 |
| Olefins | 31.7 | 25.6 |
| Aromatics | 19.0 | 19.9 |

The invention claimed is:

1. A catalytic cracking process for producing an effluent with a high olefin content, comprising:

contacting a feedstock oil and a hot regenerated catalyst in a reactor in a fluid catalytic cracking unit;

converting the feedstock oil into reaction products comprising olefins;

separating the reaction products from the spent catalyst;

aging a fresh catalyst to obtain an aged catalyst; and feeding the spent catalyst and the aged catalyst into a regenerator for oxidative regeneration to obtain the hot regenerated catalyst, wherein the hot regenerated catalyst has an activity from 35 to 55, and wherein the step of aging the fresh catalyst comprises contacting the fresh catalyst with an aging medium comprising steam in a fluidized bed at an aging temperature from 400 to 850° C., a superficial linear velocity of the aging medium of from 0.1 to 0.6 m/s, for an aging time from 1 to 720 h.

2. The process according to claim 1, wherein the feedstock oil undergoes a cracking reaction to form cracking products and a portion of the cracking products undergo a hydrogen transfer reaction and/or an isomerization reaction, and wherein the reaction products comprise cracking products and products from the hydrogen transfer reaction and the isomerization reaction.

3. The process according to claim 1, wherein the feedstock oil is one or more selected from the group consisting of atmospheric distillation tower overhead oil, gasoline, catalytic gasoline, diesel oil, vacuum gas oil, and hydrogenated vacuum gas oil.

4. The process according to claim 1, wherein the reaction products comprise 1.9 wt % or more of isobutene based on a total weight of the feedstock oil.

5. The process according to claim 1, wherein the hot regenerated catalyst has an activity of from 40 to 50.

6. The process according to claim 1, wherein the reaction products comprise a gasoline fraction, and the gasoline fraction comprises more than 27 wt % of olefins based on a total weight of the gasoline fraction.

7. The process according to claim 1, wherein the aged catalyst that has an activity of not higher than 80, a self balancing time of from 0.1 to 50 h, and an equilibrium activity of from 35 to 60.

8. The process according to claim 1, wherein the aged catalyst has an activity of not higher than 75, a self balancing time of from 0.2 to 30 h, and an equilibrium activity of from 40 to 50.

9. The process according to claim 1, wherein the aged catalyst has an activity of not higher than 70, and a self balancing time of from 0.5 to 10 h.

10. The process according to claim 2, wherein that conditions for the cracking reaction comprise a reaction temperature of from 450° C. to 620° C., a reaction time of from 0.5 to 35.0 s, and a catalyst/feedstock oil weight ratio of 3:1 to 15:1.

11. The process according to claim 10, wherein the reaction temperature is from 490° C. to 620° C. and the reaction time is from 0.5 to 2.0 s.

12. The process according to claim 11, wherein the reaction temperature is from 500° C. to 600° C., the reaction time of from 0.8 to 1.5 s, and the catalyst/feedstock oil weight ratio of 3:1 to 12:1.

13. The process according to claim 2, wherein the hydrogen transfer reaction and isomerization reaction occur at a reaction temperature of from 420° C. to 550° C. and a reaction time of from 2 to 30 s.

14. The process according to claim 13, wherein the hydrogen transfer reaction and isomerization reaction occur at a reaction temperature of from 460° C. to 500° C. and a reaction time of from 3 to 15 s.

15. The process according to claim 2, wherein each of the cracking reaction, the hydrogen transfer reaction and the isomerization reaction is conducted under a pressure of from 130 to 450 kPa, and a vapor/feedstock oil weight ratio of 0.03:1 to 0.3:1.

16. The process according to claim 1, wherein the reactor is an isodiametric riser, a riser with an equal linear velocity, a fluidized bed reactor, a riser with variable diameters, or a reactor having an isodiametric riser and a fluidized bed.

17. The process according to claim 16, wherein the riser with variable diameters comprises a pre-lifting section, a first reaction zone, a second reaction zone having an enlarged diameter, and an outlet zone having a reduced diameter arranged coaxially and vertically in said order, and a horizontal pipe coupled with the outlet zone, wherein a ratio of the diameter of the second reaction zone to the diameter of the first reaction zone ranges from 1.5:1 to 5.0:1.

18. The process according to claim 1, further comprising one or more of the following steps to adjust the activity of the hot regenerated catalyst 1) decreasing a rate of adding a make-up catalyst into the regenerator;

2) decreasing an activity of the make-up catalyst; and 3) decreasing an activity of the catalyst fed into the regenerator.

19. The process according to claim 1, wherein the aging medium further comprises air, dry gas, regenerated flue gas, gas obtained by combusting air and dry gas, gas obtained by combusting air and burning oil, or nitrogen gas.

20. The process according to claim 1, further comprising providing a second fluidized bed that is in contact with the fluidized bed where the fresh catalyst is being aged; feeding the hot regenerated catalyst into the second fluidized bed wherein the fresh catalyst is heated by heat transferred from the second fluidized bed.

* * * * *